US006910524B2

(12) United States Patent
Sivilotti et al.

(10) Patent No.: US 6,910,524 B2
(45) **Date of Patent: *Jun. 28, 2005**

(54) BELT-COOLING AND GUIDING MEANS FOR CONTINUOUS BELT CASTING OF METAL STRIP

(75) Inventors: Olivo G. Sivilotti, Kingston (CA); James Gordon Sutherland, Kingston (CA); Herbert James Thorburn, Kingston (CA)

(73) Assignee: Novelis Inc., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/846,423

(22) Filed: May 14, 2004

(65) Prior Publication Data

US 2004/0211546 A1 Oct. 28, 2004

Related U.S. Application Data

(63) Continuation of application No. 09/633,584, filed on Aug. 7, 2000, now Pat. No. 6,755,236.

(51) Int. Cl.[7] ..... B22D 11/06
(52) U.S. Cl. ..... 164/431; 164/432
(58) Field of Search ..... 164/431, 432, 164/443; 239/600, 602

(56) References Cited

U.S. PATENT DOCUMENTS

| | | | | |
|---|---|---|---|---|
| 3,036,348 | A | 5/1962 | Hazelett et al. | |
| 3,041,686 | A | 7/1962 | Hazelett et al. | |
| 3,799,239 | A | 3/1974 | Dumont-Filon et al. | |
| 3,828,841 | A | 8/1974 | Hazelett et al. | |
| 4,008,750 | A | 2/1977 | Sivilotti | |
| 4,061,177 | A | 12/1977 | Sivilotti | |
| 4,061,178 | A | 12/1977 | Sivilotti et al. | |
| 4,193,440 | A | 3/1980 | Thorburn et al. | |
| 4,635,703 | A | 1/1987 | Nakato et al. | |
| 4,679,611 | A | 7/1987 | Yoshida et al. | |
| 5,363,902 | A | 11/1994 | Kush | |
| 5,701,775 | A | 12/1997 | Sivilotti et al. | |
| 6,102,102 | A | 8/2000 | Harrington | |
| 6,135,199 | A | 10/2000 | Wyatt-Mair | |
| 6,755,236 | B1 * | 6/2004 | Sivilotti et al. | 164/431 |

FOREIGN PATENT DOCUMENTS

| | | |
|---|---|---|
| EP | 0605094 | 7/1994 |
| EP | 0908255 | 4/1999 |
| FR | 2382297 | 2/1978 |
| JP | 09-192791 | 7/1997 |
| WO | WO-98-01247 | 1/1998 |
| WO | WO-99-26744 | 6/1999 |

OTHER PUBLICATIONS

Patent Abtracts of Japan, abstract of Pub. No. 63–123552, May 27, 1988 [vol. 012, No. 371 (M–748), Oct. 5, 1988].
Patent Abstracts of Japan, abstract of Pub. No. 01–040 150, Feb. 10, 1989 {vol. 013, No. 225 (M–830), May 25, 1989}.
International Search Report, International Appln. No. PCT–CA 01–011 31 (European Patent Office, Apr. 4, 2002).

* cited by examiner

*Primary Examiner*—Kevin P. Kerns
(74) *Attorney, Agent, or Firm*—Cooper & Dunham LLP

(57) ABSTRACT

A belt cooling and guiding apparatus for a casting belt of a twin belt caster. The cooling and guiding apparatus includes at least one nozzle having a support surface facing a reverse surface of the casting belt (a surface opposite to a casting surface in the casting mold), provided with a continuous slot in the support surface arranged transversely substantially completely across the casting belt. The slot allows for delivery of cooling liquid to the reverse surface of the belt in the form of a continuous film having uniform thickness and velocity of flow when considered in the transverse direction of the belt. This allows for even cooling transversely of the belt. The nozzle arrangement is also provided with a drainage opening for removal of cooling liquid downstream from the continuous slot, and a vacuum system associated with the drainage opening for applying suction to the drainage opening. One or more such cooling nozzles is provided at the entrance of the casting mold where uniform cooling is critical to the characteristics of the cast strip article.

30 Claims, 6 Drawing Sheets

BELT-COOLING AND GUIDING MEANS FOR CONTINUOUS BELT CASTING OF METAL STRIP

This application is a continuation of applicants' application Ser. No. 09/633,584, filed Aug. 7, 2000, now U.S. Pat. No. 6,755,236.

BACKGROUND OF THE INVENTION

I. Field of the Invention

This invention relates to the cooling and guiding of casting belts in apparatus used for continuously casting metal strip articles, particularly twin-belt casters used for casting aluminum alloys and similar metals. The invention also relates to belt casting apparatus incorporating such cooling and guiding equipment.

II. Background Art

The production of metal strip articles, particularly those made of aluminum and aluminum alloys, by twin-belt casting is well known in the art. Casting of this kind involves the use of a pair of endless belts, usually made of flexible but stiffly resilient steel, copper, or the like, which are rotatably driven over appropriate rollers and other path-defining means and supports. The belts define a casting mold formed between moving casting surfaces of confronting generally planar sections of the belts. Molten metal is continuously introduced into the inlet end of the mold via an injector or other feed device, and the metal is cooled as it passes through the mold, to emerge as a continuous metal strip article of desired thickness. A cooling apparatus is generally provided for each belt to provide the necessary cooling effect to cause metal solidification in the mold. Such cooling apparatus may operate by applying a liquid cooling liquid (e.g. water or water with appropriate additives) to the reverse surface of each belt, i.e. the surface opposite to the casting surface in the region of the casting mold, and then withdrawing, and usually recycling, the cooling liquid after it has provided the desired cooling effect. It is also usual in apparatus of this kind to apply a liquid belt dressing, e.g. oil or the like, to the casting surface of each belt before it enters the casting mold. This helps to control the rate of heat transfer from the molten metal to the belts and prevents the molten metal from bonding to the belts.

Twin belt casting apparatus of this kind is disclosed, for example, in U.S. Pat. No. 4,008,750 which issued on Feb. 22, 1977 to Sivilotti et al, U.S. Pat. No. 4,061,178 which issued on Dec. 6, 1977 to Sivilotti et al, U.S. Pat. No. 4,061,177 which issued on Dec. 6, 1977 to Sivilotti and U.S. Pat. No. 4,193,440 which issued on Mar. 18, 1980 to Thorburn et al. The teaching of these patents is specifically incorporated herein by reference. The '440 patent discloses an arrangement of belt cooling and guiding means that include generally planar supports for the belts made up of an array of spring-loaded cooling nozzles having hexagonal faces provided with central orifices, from which a cooling liquid is caused to flow under pressure into contact with the reverse surfaces of the belts as they pass through the casting mold. The hexagonal shape of the nozzles means that they may be arranged closely adjacent to each other to form a virtually continuous surface to provide both good support and even cooling effects. However, the nozzles are not quite contiguous so that small gaps remain through which the spent cooling liquid can be drawn under suction from below. The arrangement not only provides cooling, but also helps to hold the belts to the underlying supports by virtue of the vacuum created beneath the belts by the suction means used to withdraw the cooling liquid.

While the above apparatus has proved to be very effective, difficulties have emerged, particularly when apparatus of this kind is used to produce thinner strip articles than those produced conventionally (e.g. strip articles having a thickness in the range of 4 to 10 mm, compared to 10 to 30 mm for conventional castings), and/or those made from alloys having longer freezing ranges (e.g. those having a freezing range of 40 to 50° C., compared to up to 20° C. for alloys of shorter freezing range). Alloys of long freezing range must be cooled much more quickly and uniformly than alloys of short freezing range to achieve good surface and internal quality plus solidification within the mold. Strip articles of this reduced thickness, and articles made of alloys having longer freezing ranges, are of particular interest to the automotive industry. However, the casting of these alloys and thicknesses requires more controlled casting conditions than can be provided by previous casting cooling systems.

Accordingly, there is a need for improved belt cooling and guiding apparatus and methods so that these problems may be avoided during the use of twin-belt casting apparatus.

SUMMARY OF THE INVENTION

An object of the present invention is to improve conventional twin belt casting apparatus so that internal and surface irregularities of the cast strip article and belt deformation may be avoided, particularly when casting thin strip articles or alloys having long freezing ranges.

Another object of the invention is to make the cooling of belts of twin-belt casters more uniform transversely of the belts.

Another object of the invention is to improve the cooling rates (heat flux) that can be achieved in twin-belt casters without causing internal and surface irregularities of the resulting cast strip article, and while avoiding belt deformation.

Another object of the invention is to provide improved belt cooling and guiding means that can be used with twin belt casting apparatus.

The present invention, at least in its main aspect, is based on the finding that, when using twin-belt casting to create thin metal strip products or products of alloys having long freezing ranges, particularly when a liquid belt dressing is applied to the casting surfaces, a very high degree of uniformity of cooling is required transversely of the belts in the region immediately adjacent to the casting mold inlet where the molten metal is first brought into contact with the moving casting surfaces. This degree of uniformity is greater than the degree conventionally obtained with apparatus of the kind described above, and is a consequence of the fact that, in the region where the molten metal is first introduced into the mold, all or a portion of the liquid belt dressing will volatilize and form an insulative gas layer that has a major influence on the heat transfer from the metal to the belt. The uniformity of the volatilization and the insulative gas layer depends on the uniformity of the belt temperature and thus on the uniformity of the belt cooling.

In the present invention, to achieve the desired high degree of transverse temperature uniformity, and desirably a high rate of cooling, cooling liquid is delivered to the reverse side of the belts in this region by means of cooling nozzles having transversely arranged continuous cooling slots, rather than by means of a number of small individual nozzles having one or more discrete delivery openings, or even quasi-linear nozzles having a large number of small openings aligned transversely of the belts.

Thus, according to one aspect of the present invention, there is provided a belt cooling and guiding apparatus for a casting belt of a twin belt caster provided with a pair of rotatably supported endless casting belts, a casting mold formed between moving casting surfaces of confronting generally planar sections of the belts, the sections having reverse surfaces opposite the casting surfaces, the casting mold having a molten metal entrance at one end and a solidified sheet article outlet at an opposite end, and a casting injector for introduction of molten metal into the casting mold at the entrance of the casting mold. The cooling and guiding apparatus comprises at least one elongated nozzle having a support surface facing a reverse surface of the casting belt, a continuous slot in the support surface arranged transversely substantially completely across the casting belt for delivery of cooling liquid to the reverse surface of the belt in the form of a continuous film having a substantially uniform thickness and velocity of flow when considered in the transverse direction of the belt, a drainage opening for removal of cooling liquid at a position spaced from the continuous slot, and a vacuum system associated with the drainage opening for applying suction to the drainage opening. The elongated slot is uninterrupted along its entire length so that there are no barriers to the flow of cooling liquid from the slot.

The apparatus may be produced in the form of an insert for incorporation into existing equipment beneath the casting belts, or may be built into a belt caster as an integral part thereof.

According to another aspect of the invention, there is provided a nozzle for a belt cooling and guiding apparatus, comprising a support surface for supporting a reverse surface of a casting belt, the support surface having a length corresponding to a width of said belt, an elongated continuous slot in said support surface having a length substantially the same as the length of the support surface for delivery of cooling liquid in the form of a continuous film having uniform thickness and velocity of flow along the slot, and a drainage opening for removal of cooling liquid spaced from said continuous slot.

The invention also relates to a twin belt caster of the kind described above incorporating such cooling and guiding apparatus for at least one and preferably both casting belts, positioned at and acting upon the reverse surfaces of the belts.

By the term "continuous slot" as used herein we mean an elongated orifice in the support surface of the nozzle having no interruptions from one transverse end of the nozzle (relative to the casting belt) to the other. The slot at its inner (cooling liquid entry) side generally opens into a chamber positioned within the nozzle forming a manifold supplied with liquid cooling liquid through inlet passages, the chamber being as wide as the slot is long and having sufficient volume that cooling liquid may be introduced into the chamber through the inlet tubes under pressure and delivered to the open-sided slot with equalized pressure and flow at all points along the length of the slot.

The width (in the direction of advancement of the belt) of the slot of each slotted nozzle is preferably made as small as possible without encountering problems of blockage by particles inevitably present in the cooling liquid. Preferably, the width is in the region of 0.125 to 0.15 mm (0.005 to 0.006 inch). The cooling liquid is preferably filtered thoroughly before being delivered to the nozzle to remove particles that could become trapped in the slot, i.e. particles having a dimension larger than about 0.125 mm.

Preferably the nozzle, or the first such nozzle if more than one is used, is positioned immediately adjacent to the entrance of the casting mold.

By the term "immediately adjacent to the entrance of the casting mold," we mean that the cooling nozzle(s) provided with the transverse slots are the first cooling means for the belts as the belts advance through the entrance of the casting mold, and that the cooling nozzles extend at the reverse surface of the belt from a position just before and to a distance past the point where molten metal first contacts the belt, such that sufficient heat withdrawal from the molten metal can commence to ensure normal operation of the casting process.

Preferably, there are at least two nozzles provided with such slots for each belt, and more preferably 2 to 4 such nozzles, positioned one following another and extending along the casting mold from the entrance towards the outlet by at least a distance effective to cover the region in which solidification of the molten metal is highly susceptible to transverse variations of the cooling effect (with the first such nozzle preferably positioned immediately adjacent to the entrance of the casting mold). This distance varies from belt caster to belt caster, and for a single belt caster according to the composition of the metal, the cast thickness, the casting speed, the nature of the belt and belt dressing etc., but is often at least 6.6 cm (2.6 inches), incorporating at least two slotted nozzles. If desired, the entire cooling and guiding of each belt may be provided by slotted nozzles arranged one after another along the length of the casting mold, but this is not usually preferable. Once the metal has progressed through the region of extreme sensitivity to cooling variation, the task of further cooling may be taken up by conventional cooling and guiding means (e.g. of the kind disclosed in U.S. Pat. No. 4,193,440 mentioned above), which are generally easier to mount resiliently so as to accommodate cavity convergence for providing continuous support and cooling for the metal as it shrinks during cooling. The first row of such conventional cooling and guiding means should preferably be configured to provide a smooth transition in cooling and support from the slotted nozzles to the conventional nozzles.

Each slotted nozzle of the present invention is preferably bounded on its upstream and downstream edge by a drainage opening (preferably a transverse groove in the support surface for the belt) to receive spent cooling liquid and to remove the liquid from the vicinity of the belt under suction. Each drainage opening or opening is wider (in the direction of advancement of the belt) than the slot of the nozzle next upstream (usually at least 10 times wider) so that rapid and complete withdrawal of spent cooling liquid from the reverse surface of the belt may be achieved. Of course, the width of each drainage opening should not be so great that heat transfer is disrupted due to reduced cooling liquid velocity or sagging of the belt spanning the opening due to lack of adequate support. In general, the drainage openings should have a width of preferably 1.5 to 3 mm.

The slotted nozzles of the present invention not only provide cooling for the casting belts, but also act, to a major extent, as guides for the belts. That is to say, the nozzles provide physical support for the belts, and also act by means of vacuum or suction to hold the belts against perturbations of their positions caused by mechanical or thermal forces. The belts are thus drawn to the nozzle support surfaces to achieve an equilibrium "stand-off" (separation) that allows the type of cooling liquid flow described above. This holding action is due partly to the suction applied by the apparatus to remove the cooling liquid from the apparatus, but may also be due in part to a Bernoulli effect created by the cooling liquid flowing over the faces of the slotted nozzles. The nozzles may be designed to optimize this effect, e.g. by suitably profiling the support surfaces of the nozzles in the region of the slot, or at the extreme edges of the support surfaces in the upstream and downstream directions.

The apparatus of the invention is particularly suited for use in belt casters in which a liquid belt dressing (e.g. a volatilizable oil) is applied to the casting surfaces of the belt prior to contact with the molten metal. However, the invention may be operated without the use of liquid belt dressing of this kind.

The present invention can avoid the formation of internal and/or surface defects in the cast article caused by lack of uniform cooling even when casting alloys in thin sections or alloys having a long freezing range.

DETAILED DESCRIPTION OF THE INVENTION

Figure 1:
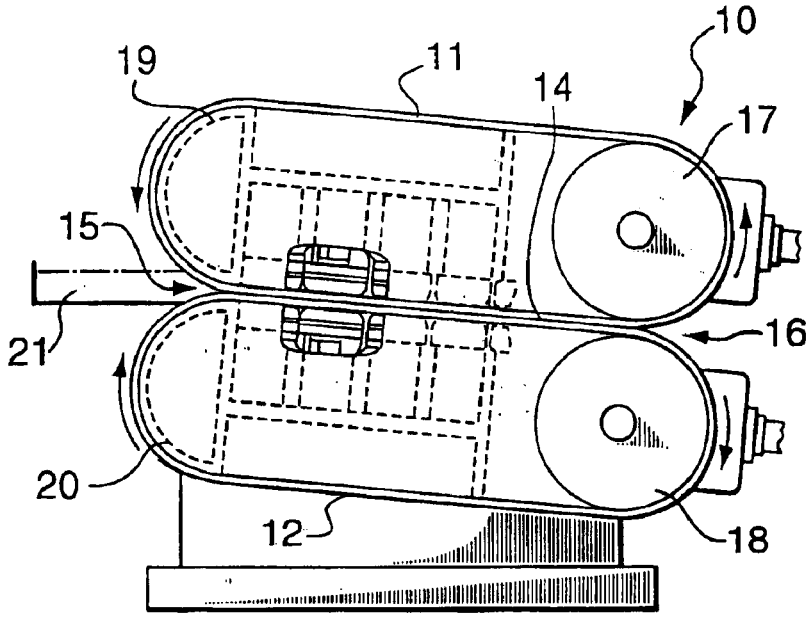
FIG. 1 is a general side view, chiefly in elevation and relatively simplified without associated drive or supporting means, of a twin-belt casting apparatus with which the present invention may be utilized.

Referring to the accompanying drawings, an example of a belt casting machine 10 is shown in simplified form in FIG. 1. The machine 10 incorporates a pair of rotatable, resiliently flexible, heat-conducting casting belts, being upper and lower endless belts 11 and 12, which are arranged to travel in oval or otherwise looped paths in the directions of the arrows, so that in traversing a region where they are facing each other, optionally moving with a small degree of downward slope, the belts define a casting mold 14 extending from a molten metal entrance 15 to a solidified strip article discharge outlet 16. After passing through the casting mold and emerging from the outlet 16, the belts 11 and 12 are rotated around and driven by large driving rollers 17 and 18, to return to the entrance 15 after passing around curved guiding structures 19 and 20 (referred to as hover bearings). The driving rollers 17 and 18 are connected to suitable motor drives (not shown).

Molten metal may be fed into the casting mold 14 by means of an injector 21 of known kind, for example as described in U.S. Pat. No. 5,671,800 which issued on 30 Sep. 1997 to Sulzer et al., the teaching of which is specifically incorporated by reference. As the molten metal in the mold 14 moves along with the belts, the belts are continuously cooled to cause solidification of the metal, so that a solid cast strip article (not shown) is discharged at outlet 16. Means for cooling the reverse surfaces of the belts as they pass through the mold 14 are provided for this purpose.

In conventional apparatus, e.g. as disclosed in U.S. Pat. No. 4,193,440, the cooling means may be formed by a large number of substantially flat-faced, hexagonal-sided nozzle structures, arranged so as to cover, with a slight spacing from the belt, the area facing the reverse surface of each belt, i.e. the surface of the region of each belt in the mold 14 opposite to the casting surface that contacts and shapes the molten metal. The assembly of nozzles provide both support for and cooling of the sections of the belts passing through the mold. Each nozzle has at least one orifice through which liquid cooling liquid (e.g. water or an aqueous solution) is projected perpendicularly against the reverse surface of an adjacent belt, whereupon the cooling liquid flows outwardly over the support surface (flat face) of the nozzle. In this way, the cooling liquid is maintained as a fast flowing layer between the belt and the assembly of nozzle faces, so that the support surfaces may never directly contact (metal to metal) the reverse surfaces of the belt.

The nozzle units of the cooling apparatus may be carried by base structures that also act as primary manifolds for cooling liquid delivery. For example, the base structures may include heavy steel support plates having passages for receiving the stems (inner ends) of the nozzle units. Associated equipment is usually also provided for withdrawing cooling liquid from the assembly of nozzle surfaces through small gaps provided between the nozzle faces. The nozzles may be resiliently mounted on the base structure to allow limited movement of the belts during the casting process when cavity convergence is used to urge the belts into contact with the metal within the casting mold.

Figure 2:
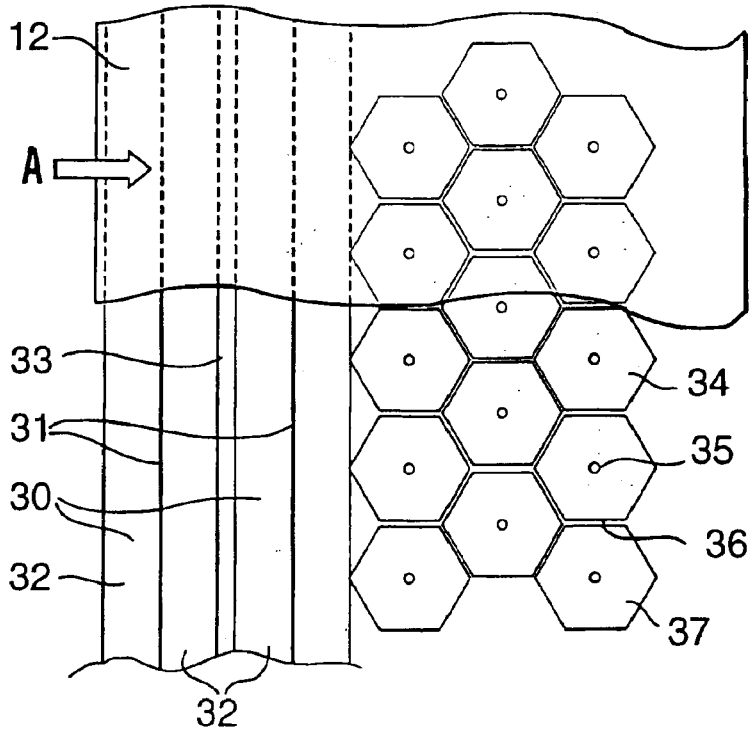
FIG. 2 is a partial top plan view of a support surface for a lower belt of the apparatus of the kind shown in FIG. 1, showing cooling and support apparatus according to one form of the present invention, and also showing conventional cooling means and a part of the lower casting belt.

In the present invention, as shown in a preferred embodiment in FIG. 2, at least some of the cooling liquid is introduced via at least one nozzle 30 that is elongated in the transverse direction of the associated belt 12 and is provided with an elongated slot 31. The figure shows two such nozzles 30, but there may be as few as one, and there are usually at least 2 to 4, arranged one after another transversely of the longitudinal direction of the belt 12 (indicated by arrow A) extending essentially completely from one side of the belt to the other facing the reverse surface of the belt. The slots 31 are provided in the generally planar support surfaces 32 of the nozzles 30 and are positioned immediately adjacent to the molten metal entrance 15 of the casting mold 14 so that cooling liquid introduced through the slots is the first cooling liquid to contact the reverse surface of the casting belt 12 as the belt moves through the casting mold in the direction of belt advancement. The support surfaces of adjacent nozzles are separated from each other by gaps 33 (only one such gap is shown in FIG. 2) that act as cooling liquid drains.

The slots 31 should preferably be centrally located within the support surfaces and should preferably be of constant gap width along their entire length (transverse to the belt). It is normally preferable to design the slots to be sufficiently narrow that the cooling liquid flow through the gap is comparable to that which would be provided by a series of point source nozzles of a conventional type (i.e. hexagonal nozzles) located across the same length. However the slots in the present invention are made sufficiently wide that the gap can pass nearly all of the detritus particles that may exist in the cooling liquid, otherwise the slots will become blocked by solid particles in certain sections, thus creating uneven liquid flow, and thus uneven cooling, transversely of the casting belt. In practice, this means that the slots should normally be no narrower than 0.125 mm (0.005 inch), and should preferably have a width in the range of 0.125–0.15 mm (0.005–0.006 inch), which results in a somewhat larger cross-sectional area in the slot than would be predicted based on the equivalence to the point inlets of a row of conventional nozzles To prevent particles with a dimension larger than 0.005 inch entering the cooling apparatus, it is preferable that effective filtering equipment (not shown) be provided for the cooling liquid before it enters the cooling apparatus. Conventional filtering equipment of any suitable kind may be used for this purpose. It may also be desirable to use a rust-inhibitor or the like in the cooling liquid to prevent the formation of rust particles in the cooling liquid supply and recirculating apparatus.

A uniform flow of cooling liquid may be caused to emanate from each slot 31 so that a uniform film of cooling liquid is created on the reverse surface of the belt 12. This provides cooling that is extremely even and uniform in the transverse direction across the belt with the result that internal and surface irregularities can be avoided in the cast strip article that emerges from the casting mold 14. Uniformity in the direction of advancement of the belt is controlled by the dimensions and spacing of the slots and drains and is sufficient to ensure that continuous monotonic cooling is achieved (no local reheating of the metal slab).

The region of the apparatus where a high degree of transverse uniformity of cooling is essential (rather than merely preferable) has been found to be limited to the front section of the casting mold from a position (in the direction of advancement of the belts) where the molten metal first contacts the casting belts and volatilization of liquid belt dressing (when used) may occur, to a position where uniform solidification is no longer critical to the surface and internal quality of the cast strip. While further cooling is required downstream of this front section of the mold, conventional cooling may be used in this downstream region. Thus, as shown in FIG. 2, immediately following the slotted nozzles 30, the support and cooling of the belt may be provided by a plurality of resiliently-mounted hexagonal-sided nozzles 34 of the type disclosed in U.S. Pat. No. 4,193,440, having central openings 35 for injection of cooling liquid, and having a cooling liquid withdrawal system including drainage gaps 36 and drain passages (not shown) below the hexagonal support surfaces 37. In contrast, the slotted nozzles themselves are generally not mounted resiliently (i.e. they are rigidly mounted) in the casting apparatus, mainly because of reduced need for such mounting in the entrance section of the casting mold where the metal is only partially solidified.

Figure 3A:
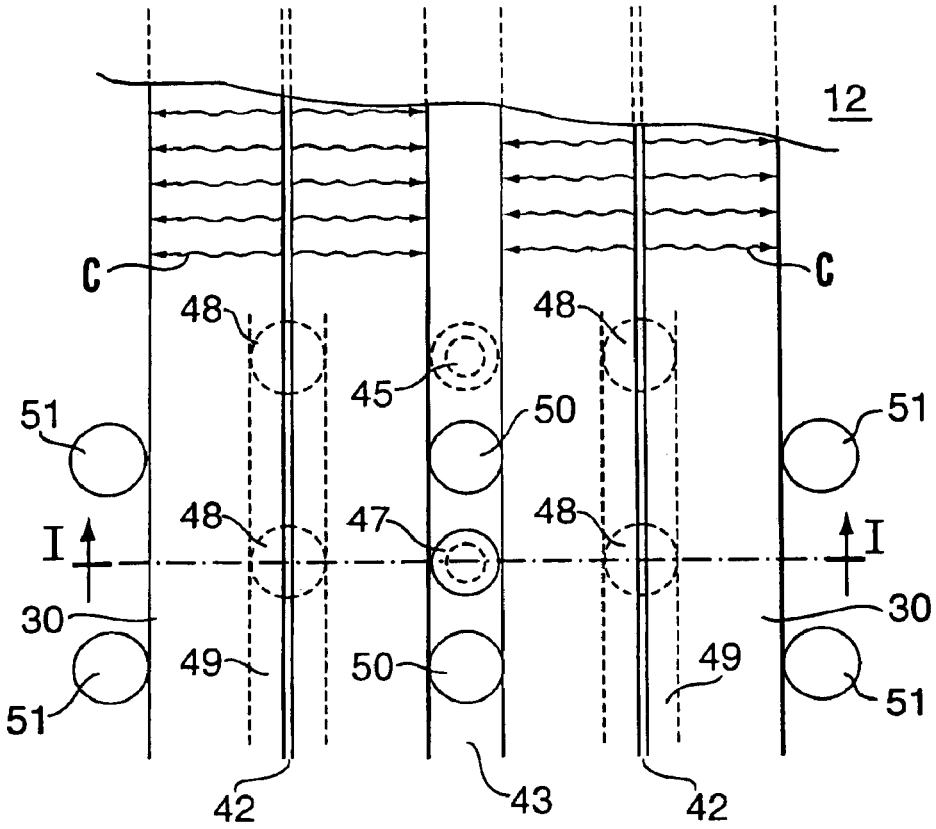
FIGS. 3A and 3B are a partial plan view and vertical cross-section, respectively, of an embodiment of slotted nozzles according to the present invention, the figures being mutually aligned, and FIG. 3B being a section along line I—I shown in FIG. 3A.
Figure 3B:
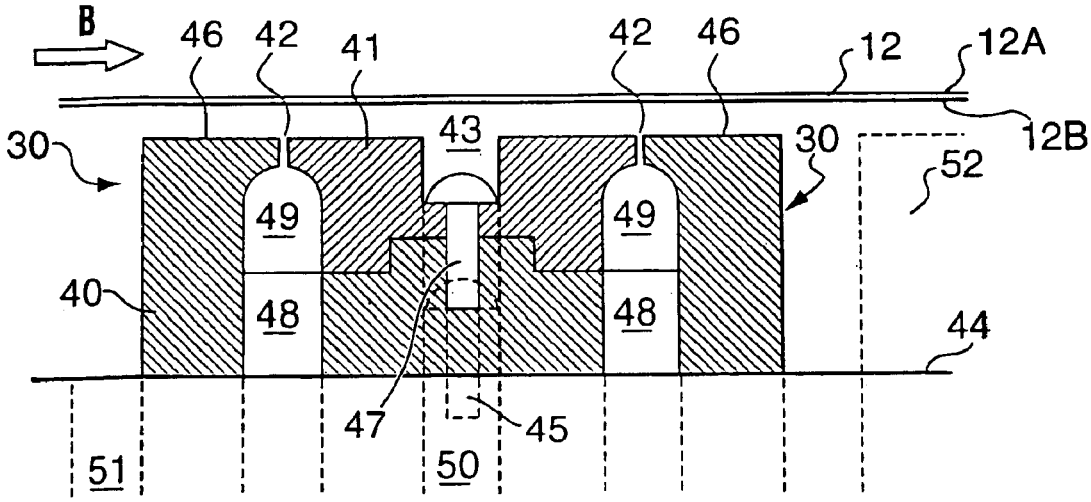

FIGS. 3A and 3B are two simplified views of an arrangement of slotted nozzles according to the present invention, FIG. 3A being a top plan view and FIG. 3B being a vertical longitudinal cross-section. The views are of an assembly of two linear nozzles 30 and illustrate (by means of arrows C in FIG. 3A) the flow pattern of liquid across the nozzle support surfaces, all oriented relative to the direction of belt advancement shown by the large arrow B. The assembly consists of a base section 40 and an insert 41 that together define two slots 42 from which cooling liquid can flow into contact with the reverse surface 12B of the belt 12 (opposite to casting surface 12A). The insert 41 contains a groove 43 forming a drainage gap for the collection of cooling liquid.

The base 40 is attached at frequent intervals to the top surface 44 of an underlying cooling liquid supply chamber (not fully shown) by means of screws 45, the heads of which are recessed in counterbores in the base section. The insert 41 is attached to the base section also by means of screws 47, the heads of which are contained in the groove 43.

Immediately behind each slot 42 is a manifold 49 that runs parallel to the slot for the length of the slot and is fed with cooling liquid at intervals through passages 48 that connect to an underlying cooling liquid supply chamber (not shown). The frequency of the passages 48 and the dimensions of manifolds 49 are such that the slots 42 are fed with a uniform cooling liquid pressure.

Below the cooling liquid supply chamber is a cooling liquid drainage chamber (also not shown) that runs under vacuum. The spent cooling liquid that comes off the nozzle support surfaces 46 is collected in the drainage groove 43 and the spaces adjacent to the nozzle assembly and carried to the drainage chamber by passages 50, 51 that pass through the supply chamber.

The cooling liquid supply chamber and drainage chamber can be of any appropriate design, but are conveniently designed as described in the U.S. Pat. No. 4,061,177 mentioned above.

With the assembly shown in FIGS. 3A and 3B, the precision of the elevation of the support surfaces 46 of the nozzles 30 and the width of the gaps 42 can be assured by close tolerance machining of the body 40 and the insert 41. Having a removable insert facilitates the cleaning of the slots of detritus that cannot otherwise be removed and allows the gap width to be modified, if necessary.

FIGS. 3A and 3B shows one assembly of two linear nozzles, but it is clear from the figures that further assemblies can be added adjacent to the first as is indicated by the dotted partial outline 52 in FIG. 3B. Alternatively, hexagonal nozzles 34 (shown in FIG. 2 or those of U.S. Pat. No. 4,193,440—or other type of cooling liquid nozzles) can be placed adjacent to (downstream of) the assembly as shown in FIGS. 3A and 3B.

In the embodiment of the linear nozzle shown in FIGS. 3A and 3B, the slots 42 are shown as straight and parallel sided and meeting the planar support surface 46 of the nozzle at a sharp right angle. In alternative embodiments, the sides of the slot may be a mix of curved, convergent or divergent, and meet the top surface with a small bevel or radius. For convenience, all of these embodiments can be referred to as having "a flat top configuration."

Figure 4:
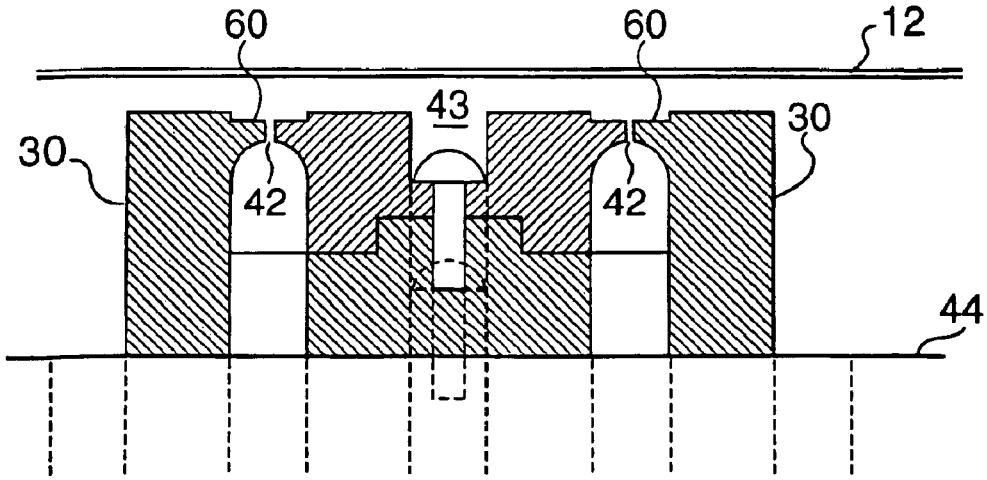
FIGS. 4 and 5 are vertical cross-sections of alternative embodiments of the embodiment shown in FIG. 4, for slotted nozzles according to the present invention.

In FIG. 4, the vertical cross-section of an alternative embodiment is shown where the slots 42 each terminate in a groove 60 in the support surface of the nozzles 30. This groove, shown as having (but not limited to) a rectangular cross-section, extends continuously along the support surface of the nozzle for the full length of the slot 42. The purpose of the groove is to minimize the wear and reduce the risk of damage or shut-off of the slot exit by the belt 12 bottoming out on the nozzle or other incidental damage. It has also been found that this grooved configuration allows the belt to move advantageously to a greater standoff from the nozzles while maintaining a continuous moving film of cooling liquid between the belt and nozzles. This permits more flexible operation in terms of variability of standoff than is possible with other designs.

Figure 5:
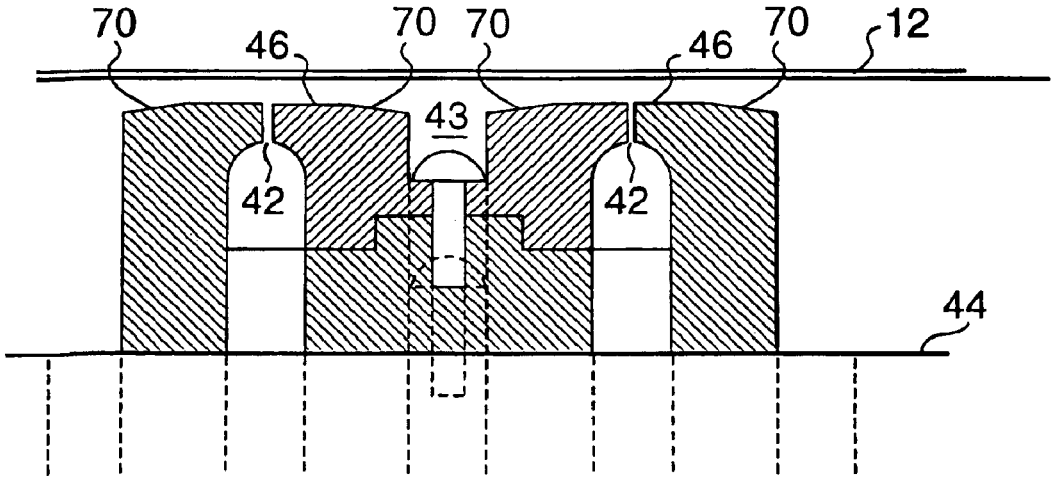

FIG. 5 shows a further embodiment wherein the slot 42 terminates in the same manner as in FIG. 3, but where the support surface 46 of the nozzle is beveled downwardly as shown at 70 for a distance adjacent to the cooling liquid drainage gap 43 on each side of the nozzle. The bevel is shown exaggerated in the figure, but preferably extends inwardly 2.5 to 3.5 mm (0.1 to 0.15 in.) horizontally from the outer edge of the nozzle. The bevel preferably extends downwardly by about 0.125 mm (0.005 in.). The purpose of this beveled configuration is to create conditions whereby the cooling liquid flow in the horizontal direction through the expanding gap between the belt and the nozzle surface creates an additional local vacuum which assists in belt stabilization, as will be more fully discussed in the following.

It should be noted that any of the slot variations described for FIGS. 3A and 3B may be used with the beveled configuration, and that the grooved (FIG. 4) and beveled configurations may also be used together.

Figure 6A:
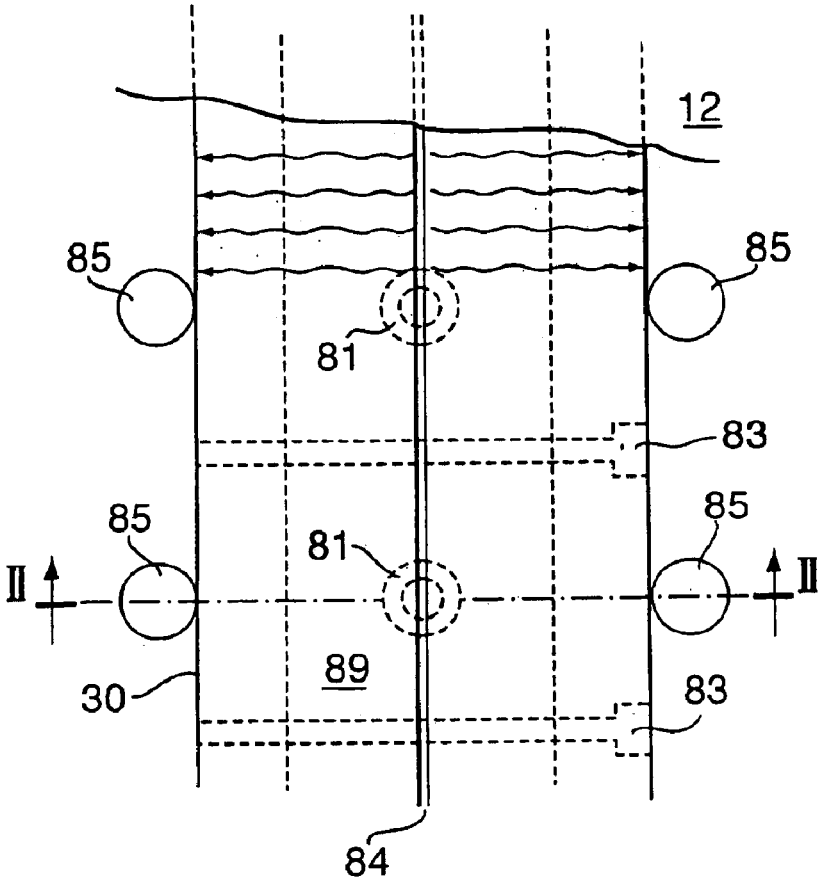
FIGS. 6A and 6B are a partial plan view and vertical cross-section, respectively, of a part of a belt caster showing an alternative nozzle design according to the present invention, the views being mutually aligned and FIG. 6B being a section along line II—II of FIG. 6A.
Figure 6B:
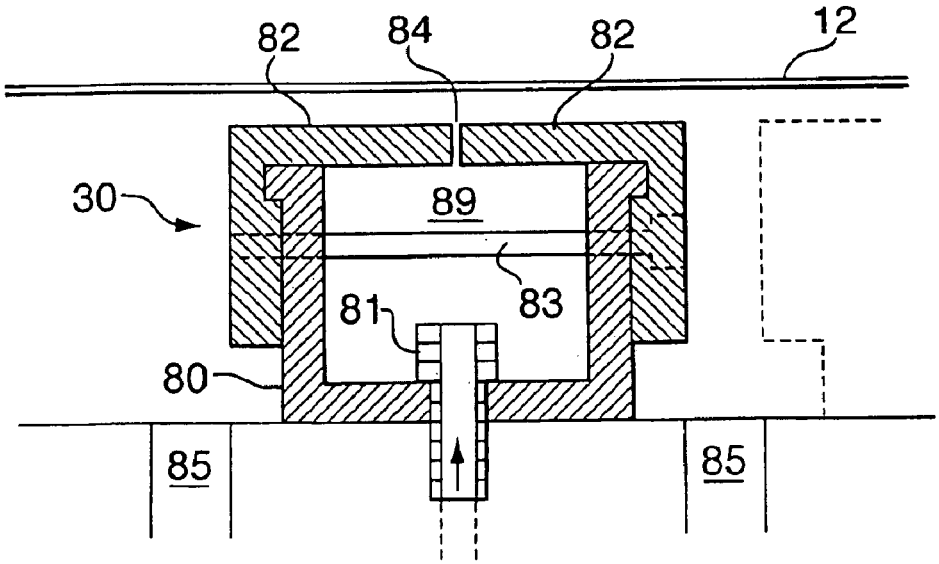

An alternative embodiment of the invention consisting of a single linear nozzle is shown in FIGS. 6A and 6B. The nozzle support surface is of the same flat top configuration as shown in FIGS. 3A and 3B, but any of the other slot and surface variations may equally be used. The nozzle 30 consists of a bottom section 80 that is held by bolts 81 to the top surface of the cooling liquid supply chamber (not Filly shown) and an upper section formed by two top members 82. The two top members and the bottom section are held together by through bolts 83. The top members are machined precisely to mate with the bottom section and give the required elevation, and to provide a gap 84 between the adjacent faces of the top members which can be further adjusted by the bolts 83. Cooling liquid is fed to the nozzle from the cooling liquid supply chamber through passages in the bolts 81, or alternatively through separate supply ports, into a manifold 89 formed by the bottom section 80 and the top members 82 and extending the full length of the slot 84. Cooling liquid flowing off the nozzle is removed through passages 85 similar to those at the edges of the nozzle assembly in FIGS. 3A and 3B.

Figure 7:
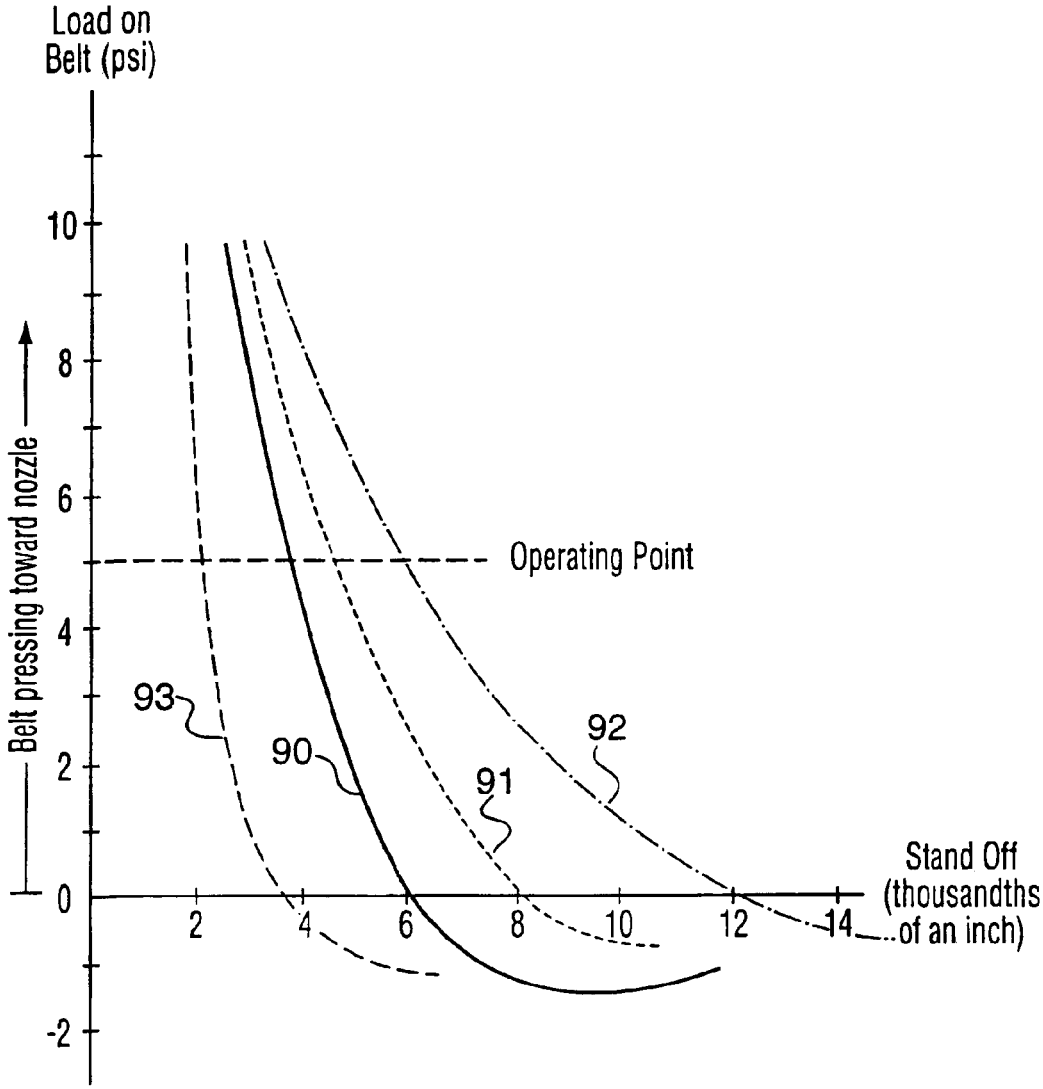
FIG. 7 is a graph showing load on the belt versus belt stand-off for apparatus according to the present invention and conventional apparatus for comparison.

Typical load/standoff curves for the three configurations of nozzle (flat top, grooved and beveled) are shown in FIG. 7 and are compared to a typical curve for a hexagonal nozzle. The curves are a plot of the load acting on the belt versus the thickness of the minimum gap (water film) between the nozzle and the belt, referred to as the "standoff". The dominant load on the belt is usually that produced by the vacuum in the cooling liquid drainage chamber and it tends to press the belt against the nozzle to a normal standoff or "operating standoff". Loads from other sources may act on the belt, such as the bending due to a thermal gradient through the belt or the bending of the belt coming off the hover bearing (or other guiding device), and try to perturb it from this operating point, loads that augment the vacuum, to a lower standoff and loads that counter the vacuum, to a higher standoff. The resistance of the belt to these changes in standoff is represented by the slope of the load/standoff curve at the operating point; the higher the slope the less change in standoff that occurs for a given perturbing force. A high slope is a very desirable characteristic for a nozzle because it tends to stabilize the position of the belt and the flow of cooling liquid, which in turn stabilize the heat transfer.

If the perturbing forces become very large in the direction that counters the vacuum, there are additional characteristics of the load/standoff relationship that are important. The first is to have as much resistance as possible against the belt being pulled off the nozzle. This can be enhanced if the vacuum load is augmented by any Bernoulli effect generated between the belt and the nozzle surface. The second is the ability to have the cooling liquid film remain intact for as large a standoff as possible before the completely filled gap of moving cooling liquid breaks down and the cooling becomes more characteristic of a jet impinging on the surface.

A perturbing force that adds to the vacuum will tend to diminish the standoff and, if excessive, could cause the belt to bottom out on the nozzle and shut off the cooling liquid flow. This can be limited by the use of resilient nozzles.

In FIG. 7 the load/standoff characteristics for the hexagonal nozzle (as described in U.S. Pat. No. 4,193.440) is represented by curve 90, the flat top configuration (FIGS. 3A and 3B, and FIGS. 6A and 6B) by curve 91, the grooved configuration (FIG. 4) by curve 92, and the beveled configuration (FIG. 5) by curve 93. From these it can be seen that the slope of the curve at the operating point, representing the resistance to perturbation of belt position, is greatest for the beveled configuration, less for the hexagonal nozzle, less again for the flat top configuration and least for the grooved configuration. However, the curves also show that the tolerance to high standoff and the maintenance of a high level of cooling is in the opposite order for the grooved, flat top and beveled configurations. The hexagonal nozzle does not follow this reversal completely and has a tolerance similar to the flat top configuration. Thus, for the linear nozzles there is a trade-off to be made; the preference is to lean towards a design having the best belt stability which allows for higher cooling rates.

Figure 8:
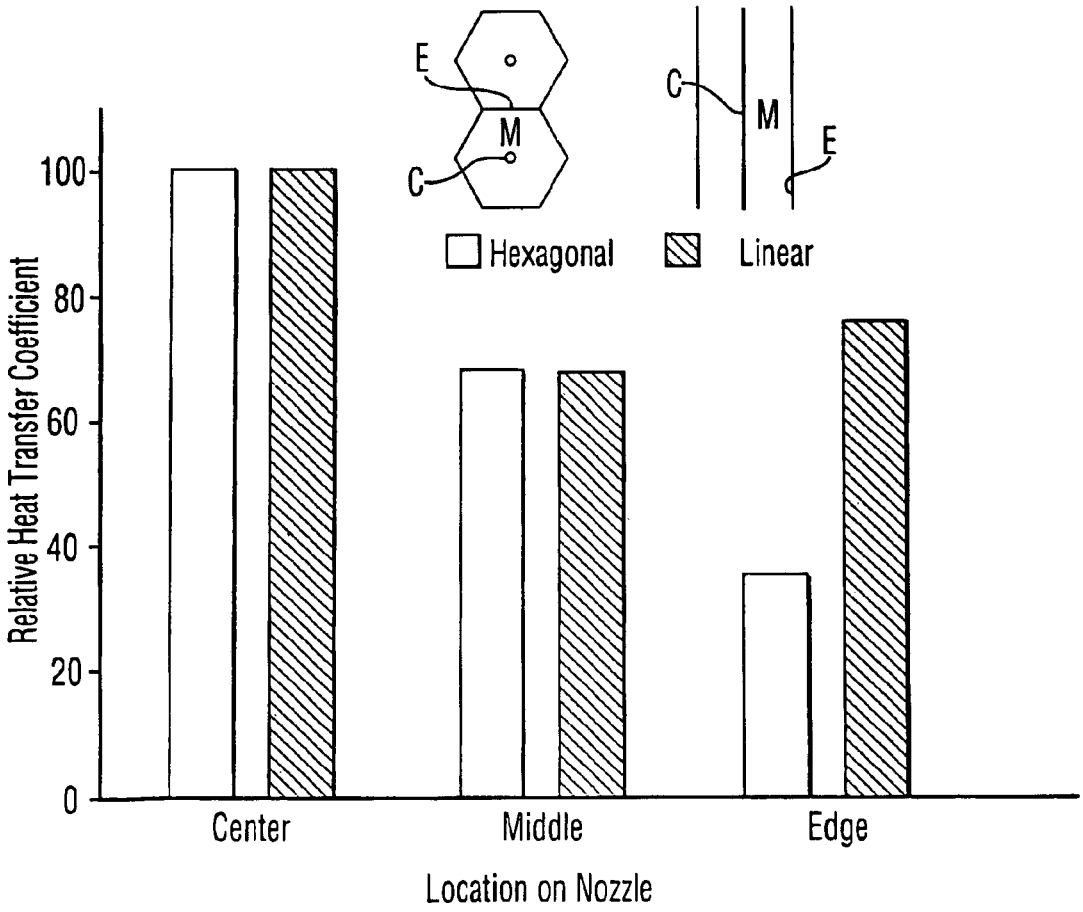
FIG. 8 is a graph showing the variation in heat transfer coefficient for a nozzle of the present invention and for a conventional apparatus for comparison.

FIG. 8 shows the relative variation of the belt-to-cooling liquid heat transfer coefficient (HTC) for a linear nozzle of the type shown in FIG. 4 compared to a conventional hexagonal nozzle (as described in U.S. Pat. No. 4,193,440), for three locations: at the center of the nozzle over the cooling liquid outlet, at the drain edge of the nozzle surface and at a point approximately halfway between. This shows that the HTC variation for a conventional hexagonal nozzles from the point of cooling liquid injection to the point of removal is substantially greater than that of a linear (slotted) nozzle of the present invention. Thus, even if a linear nozzle exhibits a load/standoff curve similar to that of a hexagonal nozzle, the reduced variation in HTC provides for an overall superior performance. Therefore, taking all the factors into account, a linear nozzles having beveled edges is generally preferred for overall performance, although the grooved nozzle (FIG. 4) has advantages where a large gap or standoff must be maintained, such as immediately adjacent to the bending of the belt over the hover bearing.

What is claimed is:

1. A twin belt caster, comprising a pair of rotatably supported endless casting belts, a casting mold formed between moving casting surfaces of confronting generally planar sections of the belts, said sections having reverse surfaces opposite said casting surfaces, the casting mold having a molten metal entrance at one end and a solidified sheet article outlet at an opposite end, and a casting injector for introduction of a molten metal into the casting mold at the entrance of the casting mold, said one end and said opposite end defining a mold region between them; said caster including a cooling and guiding apparatus for at least one of said casting belts, said apparatus comprising at least one nozzle having a support surface positioned adjacent to a reverse surface of said one casting belt, but spaced from said reverse surface by an operating standoff, said support surface having a continuous elongated slot arranged transversely substantially completely across said one casting belt adapted to deliver a cooling liquid to the reverse surface of said belt in the form of an intact continuous moving liquid film, a drainage opening adapted to remove cooling liquid spaced from said continuous slot and to transfer suction to said reverse surface of said casting belt, and a vacuum system associated with said drainage opening adapted to apply suction to said drainage opening, whereby, in use, said moving liquid film and said suction serve to maintain said standoff between said support surface and said reverse surface of said casting belt at predetermined separation while cooling said belt with said liquid.

2. The twin belt caster of claim 1, wherein a first of said at least one nozzles taken in the direction of advancement of the said belt through said casting apparatus is positioned immediately adjacent to the entrance of the casting mold.

3. The twin belt caster of claim 1, wherein said drainage opening is an elongated gap in the support surface arranged transversely substantially completely across said casting belt.

4. The twin belt caster of claim 1, wherein the slot is of constant width along its entire length.

5. The twin belt caster of claim 1, wherein said slot has a width dimension in said direction of advancement of more than about 0.125 mm.

6. The twin belt caster of claim 1, wherein the slot has a width dimension in said direction of advancement in the range of 0.125 to 0.15 mm.

7. The twin belt caster of claim 1, including a filter for filtering particles from the cooling liquid before said liquid passes through said slot.

8. The twin belt caster of claim 1, wherein the nozzle includes an elongated chamber communicating with said slot along substantially an entire length of said slot, and at least one passage for supplying said cooling liquid to said chamber.

9. The twin belt caster of claim 1, including at least one additional elongated nozzle provided with a support surface having an elongated continuous slot arranged transversely substantially completely across said casting belt for delivery of further cooling liquid to said reverse surface.

10. The twin belt caster of claim 9, having from one to three such additional nozzles arranged in succession in the direction of advancement of said belt though the casting apparatus.

11. The twin belt caster of claim 1, wherein said nozzle is positioned immediately adjacent to said molten metal entrance of the casting mold.

12. The twin belt caster of claim 1, wherein said support surface includes a continuous elongated groove arranged transversely substantially completely across said one of said casting belts, said groove having a width greater than said slot, and said slot having an outer end terminating in said groove.

13. The twin belt caster of claim 1, wherein said support surface is planar.

14. The twin belt caster of claim 1, wherein said nozzle is rigidly mounted adjacent to said reverse surface.

15. The twin belt caster of claim 1, wherein an array of point cooling nozzles is provided downstream of said nozzle provided with said slot.

16. A belt cooling and guiding apparatus for a casting belt of a twin belt caster provided with a pair of rotably supported endless casting belts, a casting mold formed between moving casting surfaces of confronting generally planar sections of the belts, said sections having reverse surfaces opposite said casting surfaces, the casting mold having a molten metal entrance at one end and a solidified sheet article outlet at an opposite end, and a casting injector for introduction of a molten metal into the casting mold at the entrance of the casting mold, said one end and said opposite end defining a mold region between them; the cooling and guiding apparatus comprising at least one nozzle having a support surface positioned adjacent to a reverse surface of one of said casting belts, but spaced from said reverse surface by an operating standoff, said support surface having a continuous elongated slot arranged transversely substantially completely across said one casting belt adapted to deliver a cooling liquid to the reverse surface of said belt in the form of an intact continuous moving liquid film, a drainage opening adapted to remove cooling liquid spaced from said continuous slot and to transfer suction to said reverse surface of said casting belt, and a vacuum system associated with said drainage opening adapted to apply suction to said drainage opening, whereby, in use, said moving liquid film and said suction serve to maintain said standoff between said support surface and said reverse surface of said casting belt at a predetermined separation while cooling said belt with said liquid.

17. The belt cooling and guiding apparatus of claim 16, wherein a first of said at least one nozzles taken in the direction of advancement of the said belt through said casting apparatus is positioned immediately adjacent to the entrance of the casting mold.

18. The belt cooling and guiding apparatus of claim 16, wherein said drainage opening is an elongated gap in the support surface arranged transversely substantially completely across said casting belt.

19. The belt cooling and guiding apparatus of claim 16, wherein the slot is of constant width along its entire length.

20. The belt cooling and guiding apparatus of claim 16, wherein said slot has a width dimension in said direction of advancement of more than about 0.125 mm.

21. The belt cooling and guiding apparatus of claim 16, wherein the slot has a width dimension in said direction of advancement in the range of 0.125 to 0.15 mm.

22. The belt cooling and guiding apparatus of claim 16, including a filter for filtering particles from the cooling liquid before said liquid passes through said slot.

23. The belt cooling and guiding apparatus of claim 16, wherein the nozzle includes an elongated chamber communicating with said slot along substantially an entire length of said slot, and at least one passage for supplying said cooling liquid to said chamber.

24. The belt cooling and guiding apparatus of claim 16, including at least one additional elongated nozzle provided with a support surface having an elongated continuous slot arranged transversely substantially completely across said casting belt for delivery of further cooling liquid to said reverse surface.

25. The belt cooling and guiding apparatus of claim 24, having from one to three such additional nozzles arranged in succession in the direction of advancement of said belt though the casting apparatus.

26. The belt cooling and guiding apparatus of claim 16, wherein said nozzle is positioned immediately adjacent to said molten metal entrance of the casting mold.

27. The belt cooling and guiding apparatus of claim 16, wherein said support surface includes a continuous elongated groove arranged transversely substantially completely across said one of said casting belts, said groove having a width greater than said slot, and said slot having an outer end terminating in said groove.

28. The belt cooling and guiding apparatus of claim 16, wherein said support surface is planar.

29. The belt cooling and guiding apparatus of claim 16, wherein said nozzle is rigidly mounted adjacent to said reverse surface.

30. The belt cooling and guiding apparatus of claim 16, wherein an array of point cooling nozzles is provided downstream of said nozzle provided with said slot.

* * * * *